United States Patent [19]

Heron et al.

[11] Patent Number: 4,854,090

[45] Date of Patent: Aug. 8, 1989

[54] FEEDING ABRASIVE MATERIAL

[75] Inventors: Roger A. Heron, Stagsden; David H. Saunders, Olney; Robert M. Fairhurst, Mears Ashby, all of England

[73] Assignee: The British Hydromechanics Research Association, Bedford, England

[21] Appl. No.: 80,671

[22] PCT Filed: Oct. 10, 1986

[86] PCT No.: PCT/GB86/00613

§ 371 Date: Jun. 8, 1987

§ 102(e) Date: Jun. 8, 1987

[87] PCT Pub. No.: WO87/02290

PCT Pub. Date: Apr. 23, 1987

[30] Foreign Application Priority Data

Oct. 10, 1985 [GB] United Kingdom ..... 8524982
Feb. 11, 1986 [GB] United Kingdom ..... 8603292

[51] Int. Cl.[4] ..... B24C 7/00

[52] U.S. Cl. ..... 51/410; 51/436; 51/438

[58] Field of Search ..... 51/410, 436, 437, 438, 51/317, 321

[56] References Cited

U.S. PATENT DOCUMENTS

| | | | |
|---|---|---|---|
| Re. 24,716 | 10/1959 | Anselman et al. | 406/92 |
| 895,795 | 11/1908 | Sampson | 51/410 |
| 2,612,732 | 10/1952 | Ziegler | 51/12 |
| 2,759,266 | 8/1956 | Cassani | 32/58 |
| 3,084,484 | 4/1963 | Hall | 51/8 |
| 3,230,016 | 1/1966 | Gilbert et al. | 406/137 |
| 3,514,905 | 6/1970 | King | 51/12 |
| 3,577,681 | 5/1971 | Waag | 51/8 |
| 3,626,841 | 12/1971 | Schachter | 51/8 |
| 3,815,286 | 6/1974 | Piet | 51/12 |
| 4,048,757 | 9/1977 | Kubus | 51/411 |
| 4,064,293 | 12/1977 | Nicklas | 51/411 |
| 4,642,944 | 2/1987 | Fairhurst et al. | 51/436 |

FOREIGN PATENT DOCUMENTS

| | | |
|---|---|---|
| 172545 | 7/1905 | Fed. Rep. of Germany . |
| 204982 | 3/1907 | Fed. Rep. of Germany . |
| 399206 | 12/1920 | Fed. Rep. of Germany . |
| 535287 | 9/1931 | Fed. Rep. of Germany . |
| 1145549 | 3/1962 | Fed. Rep. of Germany . |

*Primary Examiner*—Frederick R. Schmidt
*Assistant Examiner*—Maurina Rachuba
*Attorney, Agent, or Firm*—Shapiro and Shapiro

[57] ABSTRACT

A high pressure jetting apparatus has an abrasive cutting nozzle, a hopper supplying abrasive material, a container for mixing abrasive and a carrier liquid at a point remote from the nozzle, and a closeable conduit for conducting the mixture at high pressure from the container to the nozzle. When the closeable conduit is closed an endless circulating path is formed between the container and the hopper to charge the container with abrasive from the hopper and carrier mixture. The mixture is conveyed under pressure from the container to the nozzle when the inlet and outlet conduits from the hopper to the container are disconnected and the closeable conduit is open.

16 Claims, 11 Drawing Sheets

FEEDING ABRASIVE MATERIAL

This invention relates to the feeding of abrasive material in a carrier liquid. Abrasive particles entrained in a liquid jet have been found useful for cutting through materials, particularly in an environment in which heat or flames cannot be tolerated.

The present invention is concerned with supplying abrasive material and carrier liquid at high pressure, that is at pressures of at least 10 bars (1 MegaPascal) and preferably above 15, 25, 35 or even 70 bars. The invention provides, according to one aspect, apparatus or a method of forming a high velocity cutting jet at a nozzle comprising (means for forming a mixture of abrasive material and carrier liquid which mixture is fed at said high pressure (as hereinbefore defined) to the nozzle. The abrasive material may be fed dry or in a slurry to a pressure vessel in which the abrasive material is then mixed with liquid at the high pressure of the liquid. The outlet of the pressure vessel may have added to it further supplies of water, for example to adjust the concentration of abrasive material, but these do not serve further to pressurize the material fed from the pressure vessel. After this optional addition, a single conduit leads to the nozzle, no mixing of the abrasive material and further supplying of water taking place at the nozzle. With only one conduit leading to the nozzle, it can be handled with greater ease than if two or more conduits were connected to it. Supplying a high pressure mixture of liquid and abrasive material to a nozzle is more efficient than entraining the abrasive mixture in a jet of carrier liquid (as described in U.S. Pat. No. 4,478,368), since the pressure of the carrier liquid drops when the jet is formed, so that the final mixture is then at a pressure lower than the original value to which the carrier liquid was raised. The inherent inefficiency of the momentum transfer process of the above U.S. specification is avoided by passing the high pressure abrasive slurry through a nozzle which effects an efficient conversion of the potential or 'pressure' energy of the fluid mixture directly or kinetic or velocity energy. The resulting high velocity abrasive slurry stream can again be used for cutting a range of materials.

The flow through the pressure vessel is preferably arranged so that, at least at the central portion of the pressure vessel, the abrasive material settles out and is not in the form of a slurry. The slurry is created at the lower portion of the pressure vessel by the local flow pattern around the slurry outlet device. In the preferred embodiment, liquid, introduced at the top of the pressure vessel displaces liquid through the voids around the settled abrasive particles. A typical voidage fraction is about 50% for settled abrasive particles. The void flow area which is available to pass the liquid flow extends across the full cross sectional area of the vessel and so the average velocity of liquid flow is (a) downwards and (b) of relatively low magnitude tending to compact the settled abrasive particles rather than fluidize them. In the region of the entry to the abrasive slurry outlet, close to the base of the vessel, the liquid flow in the voids is deflected from its downwards direction and converges into a duct area. The convergence of the flow implies a reduction in available void area and hence an increase of local liquid velocity. The liquid therefore tends to fluidize the particles in the immediate vicinity of the duct and sweeps them into that duct. The volume of locally fluidized particles is a function of the liquid flow rate, whcih in turn leads to an approximately proportional relationship between the volume of abrasive material out of the vessel/unit time and the liquid flow rate. This relationship extends down to the low flow region, but the design of the outlet duct is such that a cessation of liquid flow into the pressure vessel results in a sharply defined cessation in abrasive feed from the vessel. This has advantages both operationally and in avoiding valve wear.

This method of metering gives an approximately constant relationship between liquid flow rate and abrasive discharge rate, irrespective of the level of the abrasive charge in the vessel until it reaches the limiting condition of the surface of the settled abrasive reaching the region of fluidization at the duct.

A further advantage of this approach is that the main portion of the abrasive in the pressure vessel remains in settled condition. If it were grossly fluidized, gradation of particle sizes would occur, such as is encountered and employed when back flushing a sand filter bed. This gradation of particles would adversely affect the operation of the abrasive cutting head. The cutting rate is a function of particle size and would therefore vary during the discharge cycle of the pressure vessel.

The invention is also concerned, in another aspect, with avoiding wear of valves from the abrasive material transported through them while the valves are being operated from the closed condition to the open condition or vice versa. The invention therefore provides a method of feeding abrasive material entrained in a carrier liquid through a conduit containing a valve, comprising providing a trap in the conduit above the valve and providing a volume in the conduit below the valve sufficient to receive all the abrasive material which settles from the conduit below the trap when flow ceases. If the valve is only operated a predetermined period after flow ceases, abrasive material will have settled below the valve during that predetermined period and when the valve is eventually operated, it moves through clear carrier fluid and so is not subject to wear from abrasive material which might otherwise have become caught between relatively moving parts of the valve. Various suitable forms of trap are disclosed, for example an inverted U which divides the settling abrasive material when flow ceases into one portion which settles free of the valve and the other portion which settles through the valve to a conduit below the valve.

In a further aspect of the invention there is provided an abrasive cutting device comprising a hopper for receiving liquid and abrasive material together, a nozzle located at a lower level than the base of the hopper and a conduit for conducting liquid and abrasive material from the hopper to the nozzle, no means for pressurizing the liquid in the device being provided except for the effect of gravity on the liquid in the device. This aspect of the invention is particularly suitable when the conduit extends down a large depth, since the head of liquid and material will itself create a high pressure at the nozzle, due to gravity.

In another aspect the invention provides a method of controlling the flow of particulate material from a hopper having a cylindrical upper portion and an inwardly tapering lower portion leading to an outlet, the method comprising introducing fluid under pressure above the particulate material in the cylindrical portion to cause plug flow of material in that portion, the local velocity of the fluid being increased by the shape of the lower portion to fluidize the material therein to assist flow of the material through said outlet.

Examples of the invention and of the prior art will now be described with reference to the accompanying drawings in which.

Figure 4:
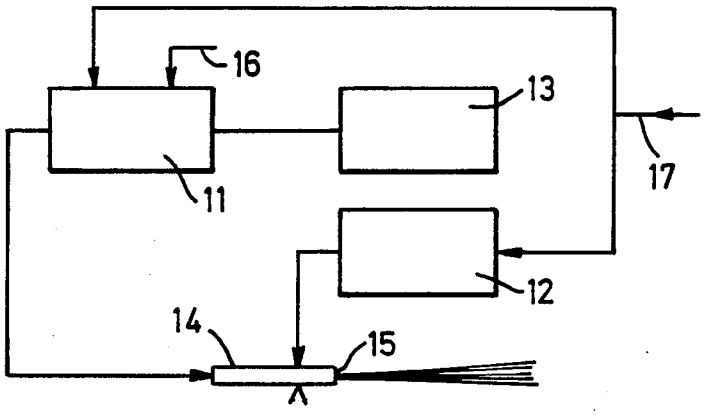
Figure 5:
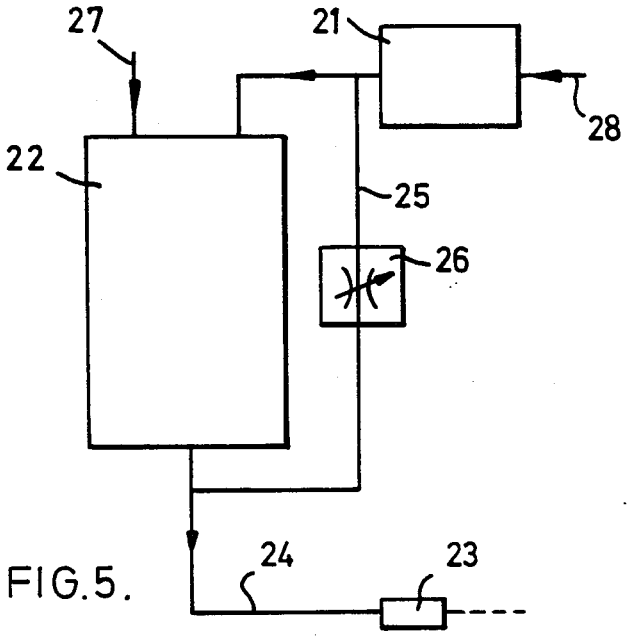
Figure 6:
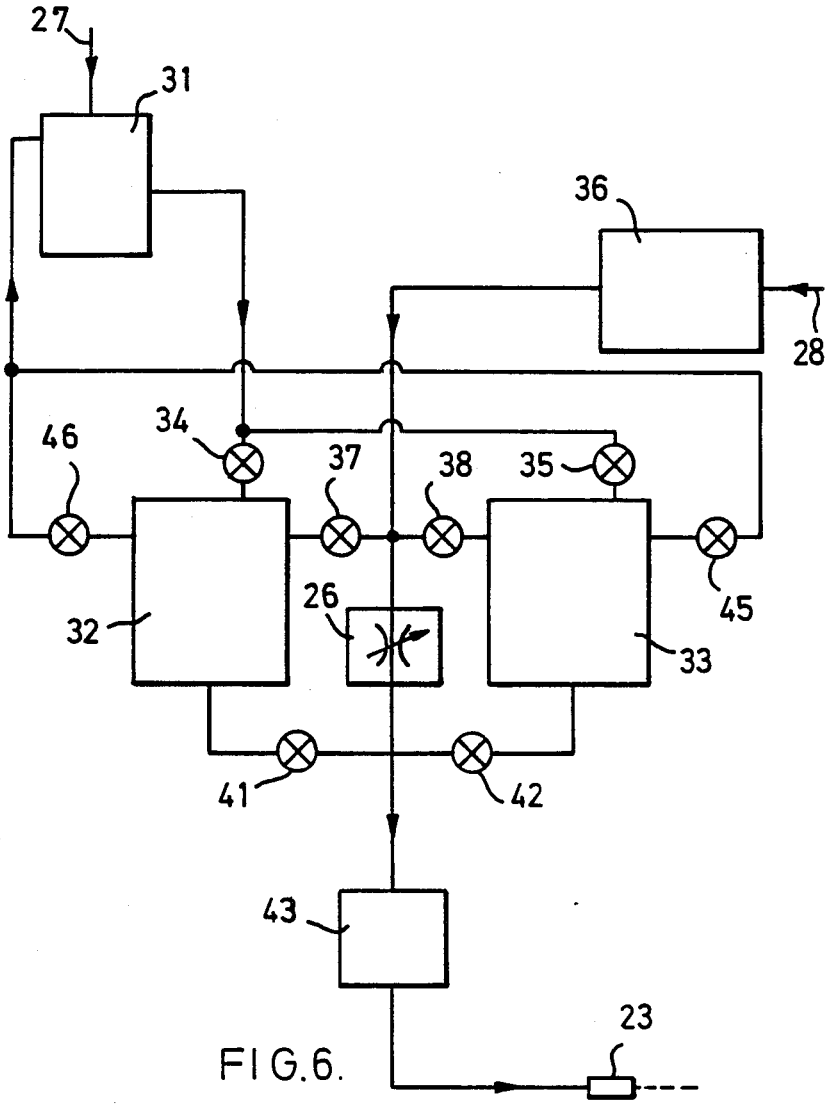
Figure 7:
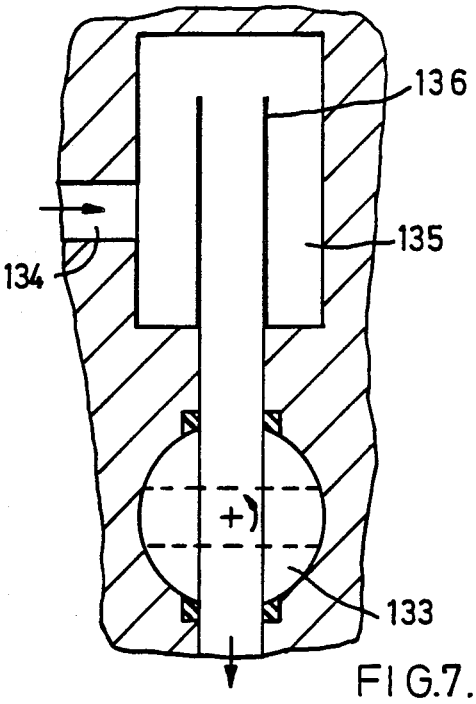
Figure 8:
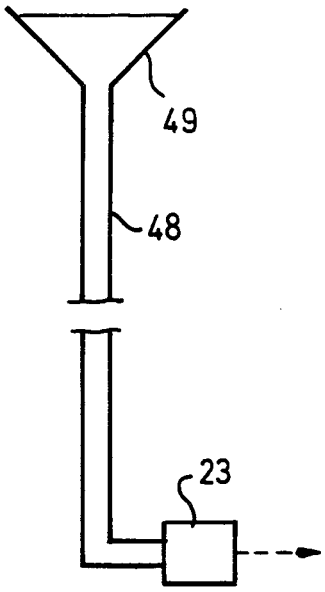
Figure 9:
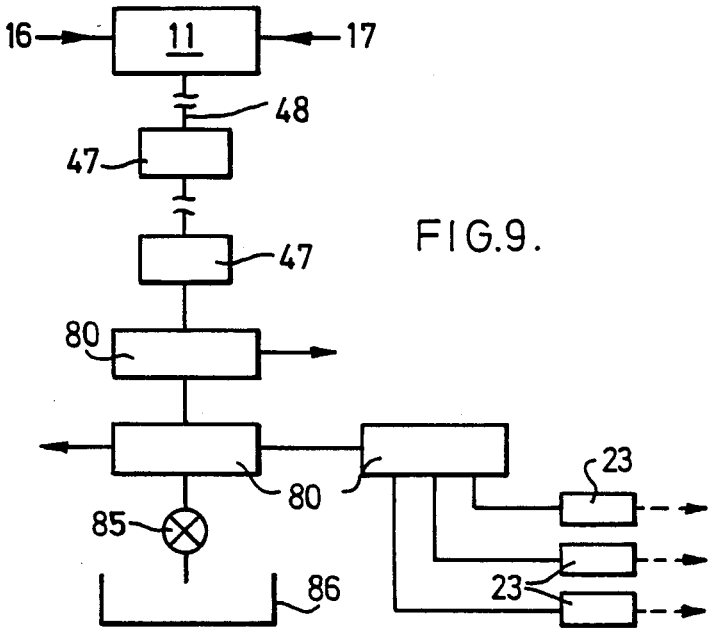
Figure 10:
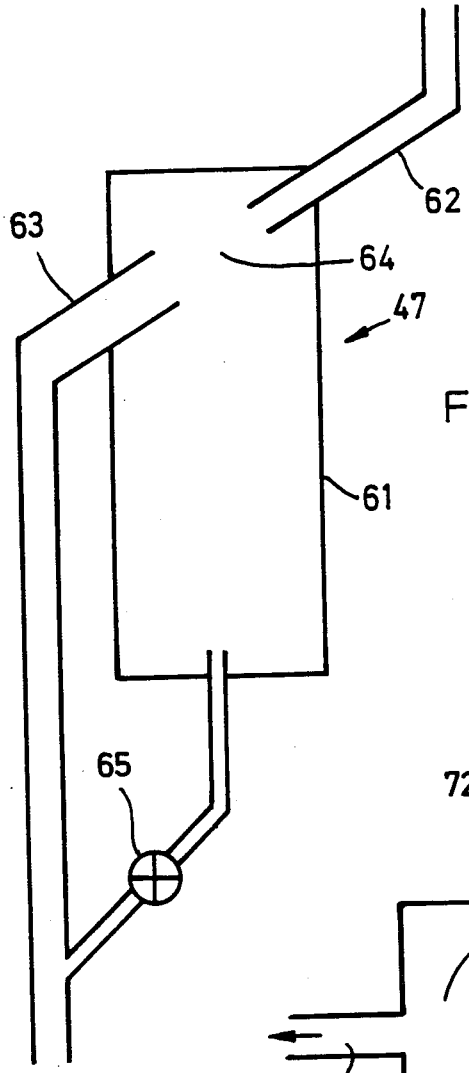
Figure 11:
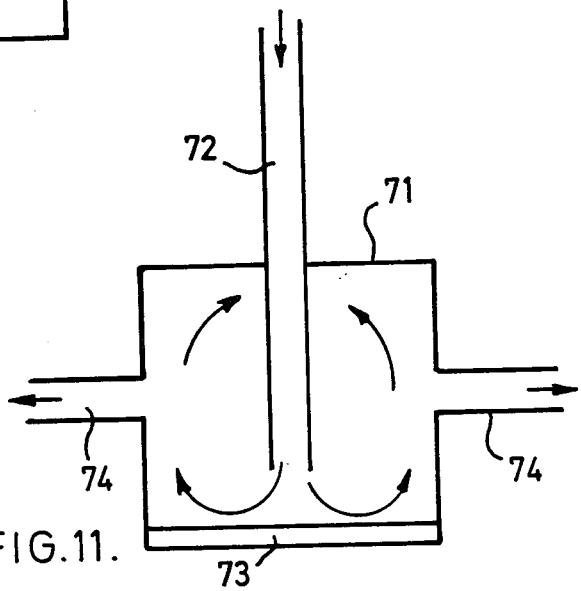
Figure 12:
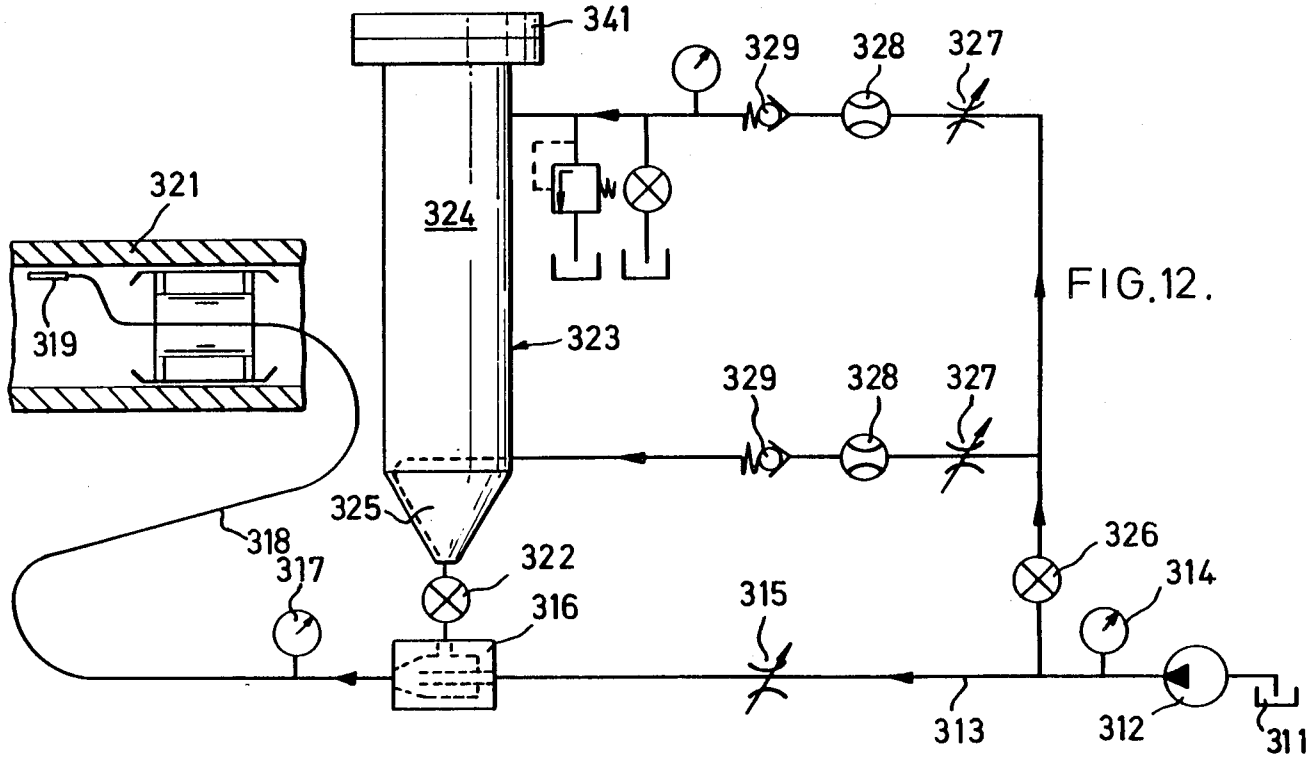
Figure 13:
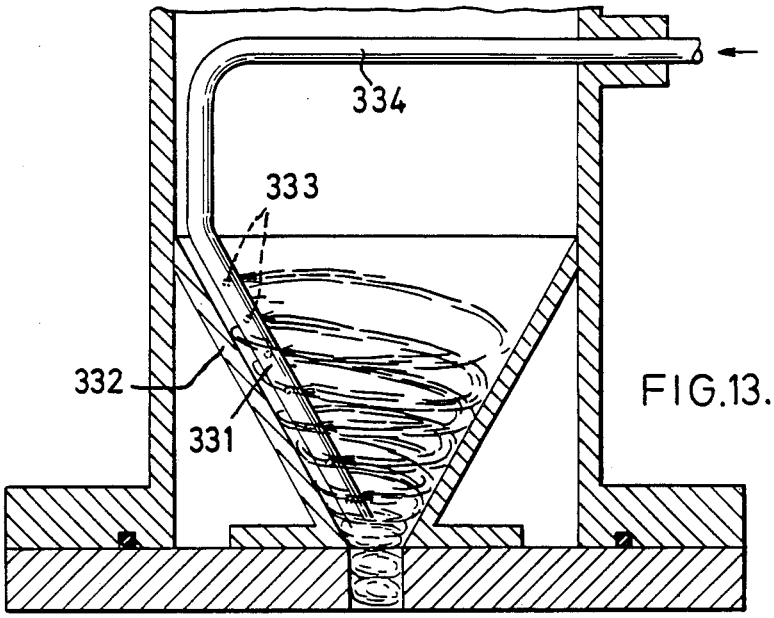
Figure 14:
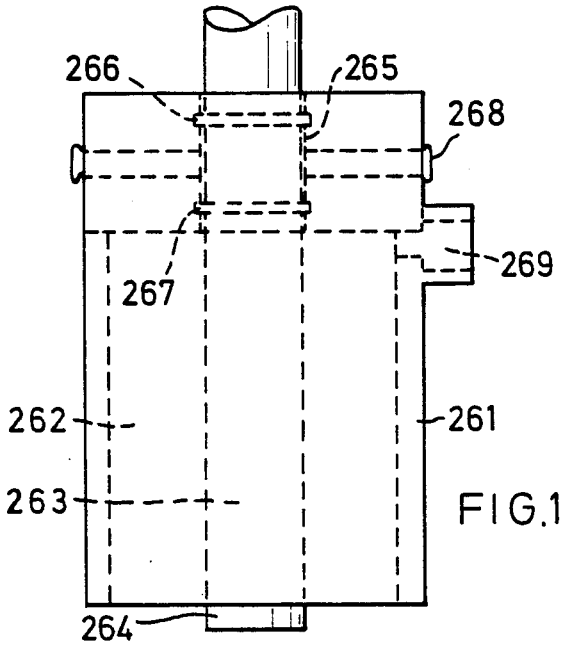
Figure 15:
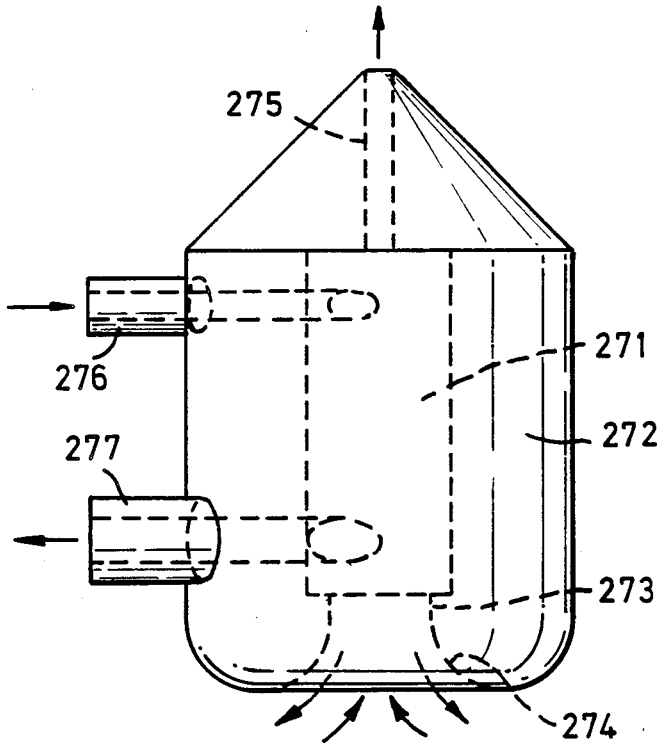
Figure 16:
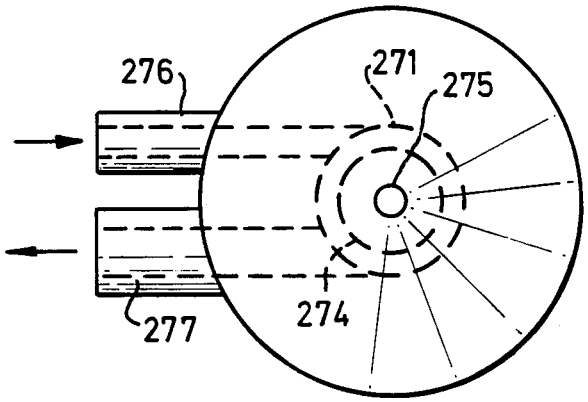

FIG. 4 is a block diagram of a prior art high pressure abrasive entrainment device, FIG. 5 is a block diagram of a batch liquid entrainment system for abrasive material, FIG. 6 is a block diagram of a continuous high pressure abrasive slurry feed system, FIG. 7 shows a flushed valve with an abrasive trap, FIG. 8 is a block diagram of a continuous high head abrasive slurry feed system, FIG. 9 is more detailed diagram of the apparatus of FIG. 8, FIGS. 10 and 11 are details of the apparatus of FIG. 8, FIG. 12 is a schematic diagram of abrasive water jet cutting apparatus, FIG. 13 is a part section, part side elevation of a detail of FIG. 12, FIGS. 14 and 15 are longitudinal sections through two alternative fluidizing devices, FIG. 16 is a plan of the device of FIG. 15

Figure 17:
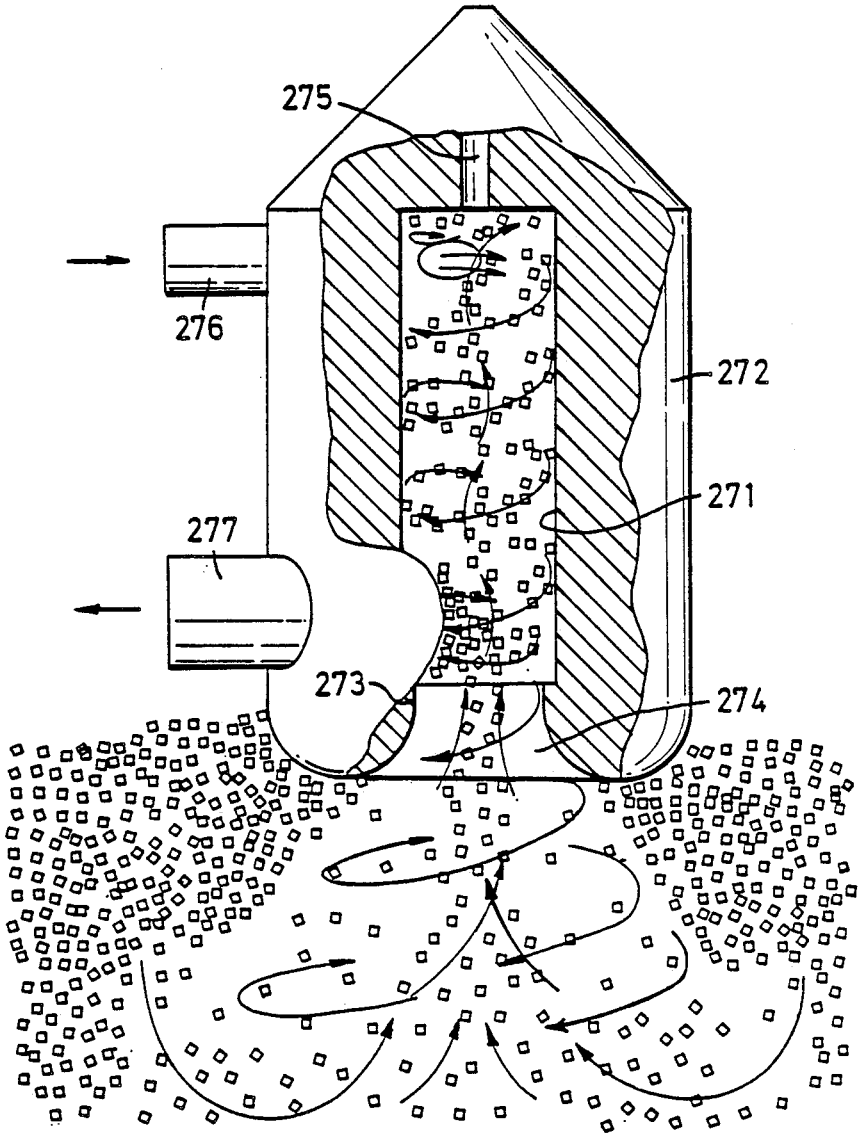
Figure 18:
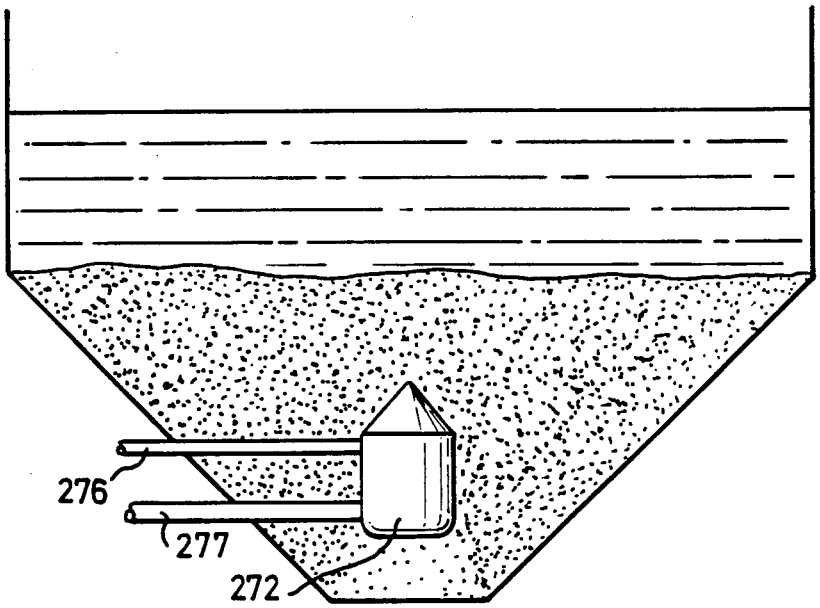

FIG. 17 is a plan, partly broken away, of the device of FIG. 16 in operation, and FIG. 18 shows the device of FIG. 17 located in a container of particulate material.

Figure 1:
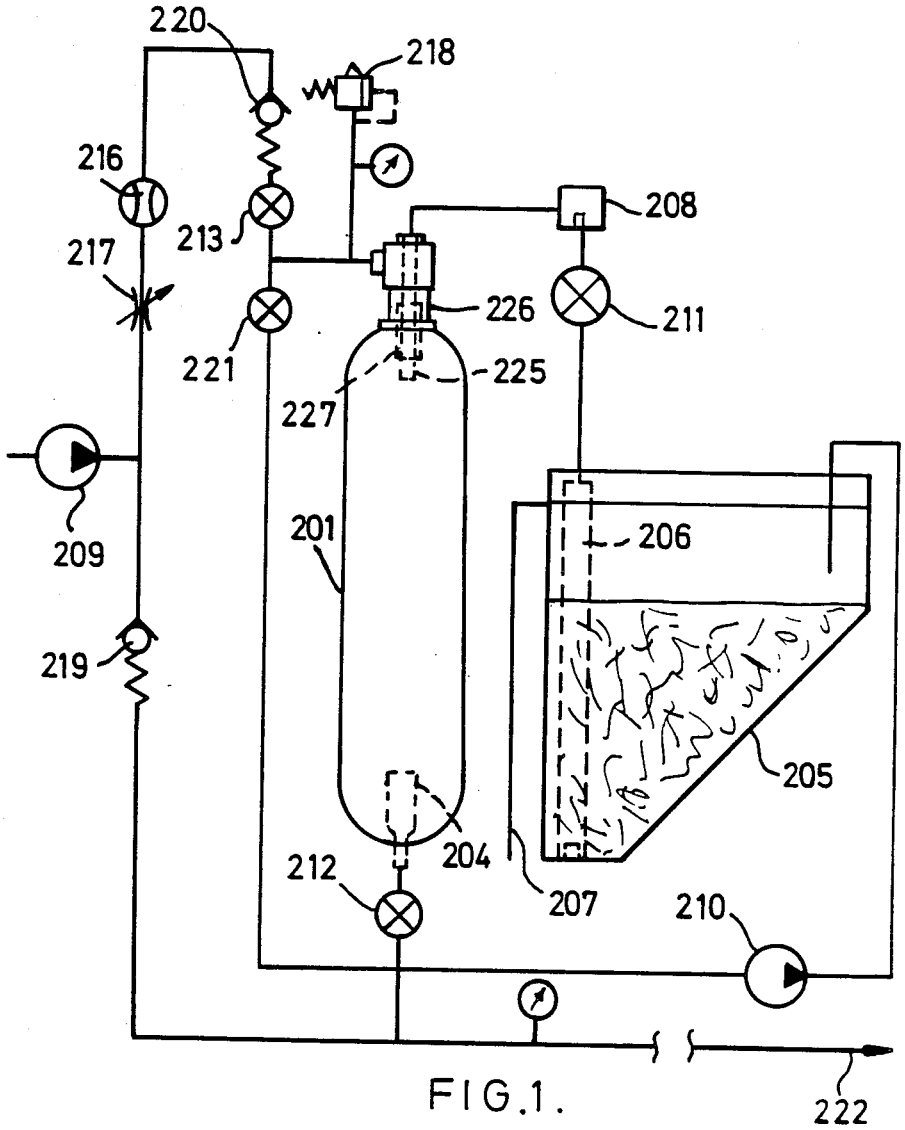
FIG. 1 is a diagrammatic view of abrasive material feeding apparatus.

In the apparatus of FIG. 1, abrasive material is fed, either in dry or in slurry form into a hopper 205 filled with water extending to a maximum depth controlled by an oveflow 207. Material from the base of the hopper can be drawn upwards through a vertical tube 206 leading to a trap 208 through a valve 211, the location of the valve being such that the volume of the conduit below the valve is greater than the volume of the conduit above the valve and below the trap by such a factor that when abrasive material of the operative concentration in the carrier fluid is present in the conduit above and below the valve and the flow stops, the abrasive material in the conduit will settle to a maximum level which is below the level of the valve. This can be achieved by making the lower portion of the tube 206 of larger cross section than the portion above the valve. The valve in the rest state will then be in clear carrier fluid and the valve can operate without drawing abrasive material into its working parts. The minimum value of the factor depends on the concentration of abrasive material in the carrier liquid, but the apparatus can be designed with a factor suitable for most working concentrations.

Figure 2:
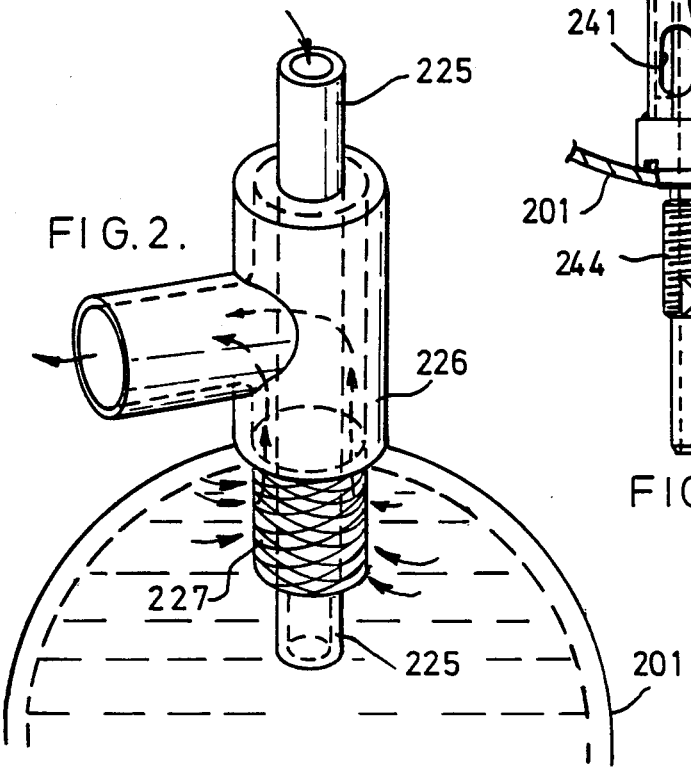
FIGS. 2 and 3 are enlarged details of the apparatus of FIG. 1.
Figure 3:
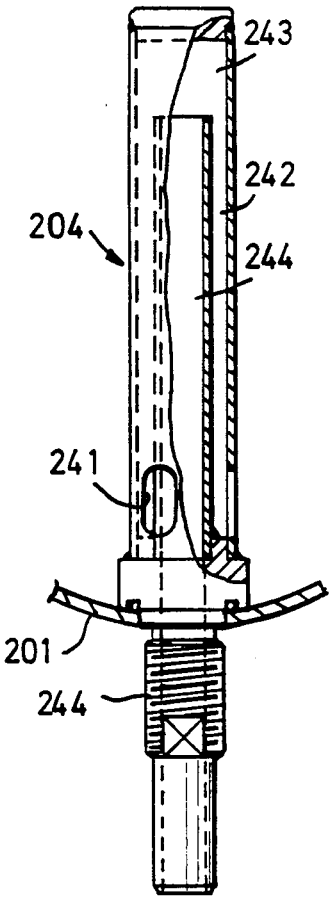

Pressure vessel 201 has two co-axial conduits at its upper end as shown in greater detail in FIG. 2 and a trap type outlet at its lower end as shown in greater detail in FIG. 3. The inner co-axial conduit 225 is connected through trap 208 and valve 211 to the tube 206. A high pressure water pump 209 feeds water in two branches; one branch leads through a variable flow restrictor 217, a flowmeter 216, a non-return valve 220 and a valve 213 to the outer co-axial conduit 226 which is provided with a strainer 227 at the entry to the vessel 201. A junction between the valve 213 and the outer co-axial conduit 226 leads through a valve 221 to a suction pump 210 which feeds water into the top of the hopper 205. The pump 210 is capable of handling an inlet suction of 63 cm Hg and low concentration slurries, since some fine abrasive material will be passed by the strainer 227. A suitable pump is a pneumatic powered diaphragm pump. The other branch from the junction at the outlet of the pump 209 feeds through a non-return valve 219 to a junction from which one branch is connected through a valve 212 to the outlet conduit 204 of the pressure vessel 201 and the other branch is connected to a discharge nozzle indicated generally by arrow 222. The non-return valves 219 and 220 are chosen so that sufficient pressure differential is created to pass a required flow through the pressure vessel 201, the remaining output of the pump by-passing the pressure vessel 201 through the valve 219. Relief valves such as at 218 are provided for safety.

At the start of operations, the pressure vessel 201 is filled with water. The suction pump 210 is energized to circulate water from conduit 226 at the top of the pressure vessel 201 through the valve 221, which is open (valves 212 and 213 being closed) into the hopper 205, and from the base of the hopper through the tube 206 back to conduit 225 of the vessel 201. Grit is supplied to the hopper and settles to the bottom. The pressure difference generated within the tube 206 and the locally increased liquid velocity fluidizes abrasive material at the inlet to the tube 206 and a slurry of water and the particulate material contained in the hopper 205 is drawn into the pressure vessel 201, where the arrangement of components and the rate of flow are chosen so that the abrasive material settles out from the slurry while the water continues its circulation through conduit 226 to the pump 210. Eventually, the settled material will reach the level of a strainer 227 at the entrance to the outer co-axial conduit 226 at the top of the container, stopping the flow when the strainer mesh becomes blocked. The abrasive material is chosen to be in a narrow band of particle sizes, so that there are plenty of voids in the material in the vessel 201 allowing liquid to flow therethrough. The presence of fines in such material would block the flow of liquid through the settled material and furthermore such fines are not efficient when the abrasive material is entrained in a jet of carrier fluid and used for cutting purposes.

Grit is discharged from the pressure vessel 201 by applying water under pressure from the pump 209 through the valve 213 to the outer co-axial conduit 226, the valves 211 and 221 being closed. This flow of water in reverse to the previous flow clears grit from the strainer 227 and water passes through the settled material to the base of the pressure vessel where the local flow pattern adjacent the output trap 204 fluidizes the material which passes through the trap 204 shown in greater detail in FIG. 3 and the valve 212 to the nozzle 222. The discharge of the pressure vessel 201 can be stopped at any time by closing the valve 213, so that water from the pump 209 is then diverted through the non-return valve 219 and abrasive material in the conduit below the trap 204 will settle through the valve 212 into the conduit between the valve 212 and the junction with the conduit from non-return valve 219, thus allowing the valve 212 to be closed, after a predetermined delay, in pure carrier liquid without the danger of abrasive materil being entrained in the working parts of the valve. As can be seen from FIG. 3, fluidized material at the base of the hopper passes through an inlet aperture 241 into an outer conduit 242 and then upwards to the top 243 of the trap from which an outlet conduit 244 leads centrally downwards towards the valve 212. When the valve 213 is closed and flow through the pressure vessel stops, abrasive material will only settle through the valve 212 from the top of 243 of the trap and abrasive material which has not yet reached the top 243 of the trap will settle back in the outer conduit 242 and will not settle through the valve 212. There will therefore only be a small volume (the volume of the conduit 244) from which abrasive material will settle through the valve and it is a relatively easy matter to arrange the conduit below the valve 212 to be of sufficient volume to accommodate all this abrasive material without danger of the level of the settled material reaching the height of the valve 212. It is not necessary for the trap to have two vertically directed passageways. For example, the inlet passageway could be horizontal or of any orientation which prevents material from the hopper settling through it to the valve 212. In designing the trap, one has to take into account the angle of repose of the abrasive material and any variations in orientation of the whole apparatus, for example if it is carried on the back of an under water diver.

The blockage of the strainer 227 when grit reaches the top of the pressure vessel 201 can be sensed to provide an automatic switching of the valves 212 and 213 and activation of the pumps 209 and 210 to change over from the charging to the discharging cycle. By causing the water to flow through the strainer 227 in the opposite direction during the discharge cycle compared to the charge cycle, the grit blocking the strainer 227 will automatically be flushed away.

FIG. 5 shows the basic layout of an embodiment of the invention which can be contrasted with a prior art entrainment system for abrasive material in water shown in FIG. 4. In the prior art arrangement of FIG. 4, a relatively low pressure slurry is formed using water as a carrier liquid, a d this slurry is mixed with further high velocity streams of plain water. The mixing of the abrasive particle slurry and high velocity plain water occurs in a suitably designed 'ejector' or 'jet pump' where a fraction of the energy in the high velocity flow stream is transferred to the abrasive slurry by entrainment and momentum exchange. The resulting abrasive flow stream can be used for cutting a range of materials. The theoretical maximum efficiency of a jet pump is 50%. This efficiency is further reduced in the case of very high ratios of pressures for the primary and secondary flows. However all known commercial abrasive jet cutting systems have employed this principle to date to: (a) avoid having to pump an abrasive slurry at high pressures, since normal high pressure water pumps would be subject to rapid and catastrophic wear if employed on this duty, and (b) avoid the very rapid wear which would normally result from applying abrasive slurry at high pressure to a conventional jetting nozzle. In the apparatus of FIG. 4, slurry is formed in a slurry unit 11 from a dry abrasive supply 16 and a low pressure water supply 17. The mixing is arranged by a compressor or hydraulic pump 13, and abrasive slurry is fed from the slurry unit 11 to a jetting gun 14 to which high pressure water is applied from a 700bar pump 12, to entrain the abrasive slurry at high velocity towards the workpiece, the pump 12 being supplied from the same low pressure water system 17 as the slurry unit 11. The jetting gun is therefore awkward in that the abrasive slurry is supplied in a separate conduit from the high pressure water and two conduits must therefore be provided to the gun making it unwieldy to direct at the target. The gun 14 is an ejector in which the abrasive slurry is fed radially into a chamber, along the axis of which the high pressure water is ejected from the nozzle, similarly to the U.S. speecification mentioned above. The momentum is transferred from a driving fluid to a second fluid supply in a mixing tube. Such devices are inherently inefficient. The approach shown in FIG. 5 avoids this inefficiency by supplying both the abrasive and driving water as a slurry at high pressure to a nozzle 23. When the mixture is actually made at high pressure, as shown in FIG. 5, no further pressurization occurs between the mixing vessel 22 and the nozzle 23, which are separated by a conduit 24 that may be flexible to facilitate directing the nozzle as required. Grit is supplied to the pressure vessel 22 either in dry or slurry form from supply 27, and a high pressure pump 21 pressurizes the water supplied from 28 to pressures such as 35 to 70 bars, (although for some applications 10,000 bars may be reached) and feeds it to the pressure vessel 22, the mixing taking place at high pressure. It may be desired to dilute the high pressure slurry formed by the pressure vessel 22 before it reaches the nozzle 23, and this is arranged by a by-pass conduit 25 passing through a variable restrictor 26, but this by-pass does not cause further pressurization of the abrasive material supplied, and only dilutes it to the concentration required for a particular cutting operation. The conduit 25 joins the conduit 24 near vessel 22 and remote from the nozzle 23. The jet from the nozzle 23 has been found to produce a clean accurate cut through sheet steel, whereas abrasive entraining systems in general produce a coarser less accurate cut.

In FIG. 6, the grit is mixed with water at low pressure to feed it into the pressure vessel and then water at high pressure is applied to the mixture to increase the pressure of the final mixture supplied to the nozzle. This is a batch process, but in order to make it a continuous feed, a pair of pressure vessels are provided with suitable valves to switch the supply to the nozzle from one pressure vessel to the other. Grit from supply 27 is mixed with water vented from parallel-connected pressure vessels 32 and 33 in a chamber 31 and is supplied by gravity to the parallel pressure vessels 32 and 33 through valves 34 and 35. Water is supplied from 28 to a high pressure pump 36 whose output is applied through valves 37 and 38 to the pressure vessels 32 and 33. The output of the pressure vessels 32 and 33 is applied through valves 41 and 42 through a grit concentration averaging device 43 to the nozzle 23. The pressure vessels 32 and 33 are vented through valves 46 and 45 back to the chamber 31 to supply the water for making the slurry. The even-numbered valves open together, in antiphase with the odd-numbered valves. When the pressure vessel 32 has been filled with low pressure slurry from the chamber 31 through valve 34, the valves are changed in state so that high pressure water is applied through valve 37 to the pressure vessel 32 to drive the slurry at high pressure to the nozzle 23 while low pressure slurry now pours into the pressure vessel 33 through valve 35. When the pressure vessel 32 is emptied of slurry and the pressure vessel 33 is full of slurry, the valves are again changed in sate and the process continues. The grit concentration averaging device 43 comprises a vortex chamber in which the quantities of slurry alternating with quantities of water enter tangentially and spiral through the chamber to an outlet. The changing velocities and the spiral path ensure that the water and the slurry are properly mixed at the outlet to provide a uniform concentration of slurry at the nozzle 23 for uniform cutting properties to minimize the changes in concentration of the grit in the slurry which may occur on change of state of the valves. Without the device 43, the nozzle would cut perforations rather than a continuous slot.

Valve assemblies 34, 35, 41, 42, 45 and 46 are of special design since they carry grit particles, 45 and 46 only to a small degree. FIG. 7 shows this design in detail. The grit suspension enters the valve at 134, through a catch chamber or trap 135 having an elevated outlet 136 leading to the ball 133. FIG. 7 shows the valve open. In general, before valve operation, the flow is stopped by operating valves working in clear carrier fluid. After a few seconds delay, the abrasive particles fall clear of the valve ball and seat, when it can be operated without risk of damage.

In the arrangement of FIG. 8, grit and water are applied together to the inlet 49 of a long vertical tube 48 whose lower end leads to a nozzle 23. This arrangement allows a mixture of grit and water to be applied to the nozzle 23 at high pressure caused by the weight of water and grit in the tube 48 without the use of any pump to apply that pressure. In FIG. 9, intermediate grit catch stations 47 are provided down the length of the tube 48 in order to prevent all the grit from sinking to the bottom of the tube when flow of slurry through the nozzle 23 is stopped. A diagram of such a station is shown in FIG. 10. A chamber 61 has an inlet conduit 62 aligned with an outlet 63 of slightly larger bore than that of the inlet conduit 62, both being inclined at angle to the vertical within the chamber 61, with a gap 64 between the inlet and outlet. When there is a flow of slurry between the inlet and the outlet, the momentum of the grit carries it across the gap 64 to the outlet. When the flow stops, the grit in the slurry at the inlet falls through the gap to the base of the chamber 61, and does not continue down the main pipe from the outlet. The chamber can be emptied by opening valve 65, and this should conveniently be done when there is flow of slurry through the system to avoid the next chamber below becoming overfilled. The chamber 61 is made large enough to catch any grit left in the tube above the grit catching station. The grit catching station could be used in place of the traps of the previously described embodiments.

When a feed to a plurality of nozzles is required to be connected to the vertical tube, a multiple-phase flow divider 80. The construction of the divider is shown in FIG. 11. A chamber 71 with a vertical inlet conduit 72 is directed downwards onto a target face 73 at the base of the chamber and outlets 74 are arranged radially around the chamber above the end of the inlet conduit 72. This arrangement ensures that the grit remains in suspension in the slurry and the concentration of grit in the slurry fed to the various outlets 74 remains uniform. The target face is made easily replaceable, since it will be worn by the impact of abrasive material. At the bottom of the tube 48, a dump valve 85 (see FIG. 9) is provided leading to a catch tank 86, into which grit and/or unwanted slurry can be emptied.

In the arrangement illustrated in FIGS. 12 and 13, water from reservoir 311 is forced by a conventional water jetting pump 312 along a supply tube 313 connected to a pressure gauge 314 through a variable valve 315 to an ejector 316. The outlet of the ejector 316 is connected to a further pressure gauge 317 and through a flexible conduit 318 to a nozzle 319 which is directed at the material to be cut away, in this case corrosion on the interior of a pipe 321. The ejector is fed with a slurry of abrasive material through a valve 322 from a supply 323.

The supply 323 of abrasive material includes a hopper having an upper cylindrical portion 324 and a lower frusto-conical portion 325 whose outlet is connected through the valve 322 to the ejector 316. Water from the conduit 313 is bled off through a valve 326 to two parallel arms, each comprising a flow adjuster 327, flowmeter 328 and non-return valve 329. Fluid in the upper parallel arm is fed to the top region of the cylindrical portion 324 of the hopper to move the undisturbed abrasive material contents contained within the cylindrical portion 324 towards the frusto-conical portion 325. The water in the lower parallel arm is fed through a connecting arm 334 to an outlet tube 331 which, as can best be seen in FIG. 13 lies parallel to the wall 332 of the frusto-conical portion 325 and in a vertical plane. The outlet passages 333 from the interior of the tube 331 are directed parallel to the wall 332 and inclined downwardly at least 30° to the horizontal. Water flowing through the passages 333 fluidizes the abrasive material in the frusto-conical portion 325 due to the locally increased velocity and directs it towards the outlet. The precise angles of the taper of the lower portion 325 and of the inclination of the passages 333 can be adjusted to suit the materials and fluids in use. It is not necessary for the connecting conduit 334 from the lower parallel passage to the tube 331 to extend across the hopper as illustrated.

The quality of the slurry fed to the nozzle 319 can be controlled by relative adjustment of the two adjusters 327 and valve 315. Pressure gauges may be provided to monitor the quality.

Variations of the illustrated apparatus lie within the scope of invention. For example, a plurality of tubes 331 can be provided. The half-angle of the cone of the frusto-conical portion can be other than the 30° illustrated. Since the output of the hopper 323 is already a slurry, it could be connected directlt to the nozzle 319. When the slurry is to be mixed with further high pressure fluid from the conduit 313, a simple junction could be provided in plate of the ejector 316.

FIG. 14 illustrates a fluidizing device having a cylindrical body 261 with an axial bore open at its lower end and divided into two coaxial chambers 262 and 263 by an axial stainless steel tube 264. The tube 264 is slidably mounted in a bore 265 in the closed upper end of the body and can be secured in position by holding grub screws 268 with an O-ring 266 or 267 sealing the tube to the bore on either side of the screws. The axial position of the tube 264 can be adjusted to suit the application of the device. A tangential inlet 269 is provided adjacent the upper end of the chamber 262.

In operation, fluid introduced into the chamber 262 through the inlet 269 passes with a swirling motion to the open end of the body, where it entrains and fluidizes particulate material in the adjacent region. The fluidized material is then drawn up through the tube 264 to an outlet (not shown), motion being caused by suction applied to the outlet or pressure applied to the particulate material in the container surrounding the body.

FIGS. 15–18 show a device similar to that of FIG. 14 except that only one chamber 271 is formed within the body 272. Referring to FIGS. 15 and 16, the chamber 271 has a reduced diameter portion 273 at the lower end with a bell-mouth opening 274 and it is also provided with an air vent 275 at the top, for use in situations when build-up of air in the chamber 271 is an undesirable possibility. A non-return valve may be provided in the air vent 275. Besides a tangenial inlet 276 to the upper portion of the chamber, there is a tangential outlet 277 from the lower portion of the chamber, above the portion of reduced diameter, the outlet 277 being of larger dimensions than the inlet and located to receive fluid caused to circulate in the chamber by the inlet 276. The upper portion of the body is conical to facilitate the flow of particulate material thereover, the air vent 275 extending axially through the bottom of the body and the reduced diameter portion are preferable although not essential; they may also be incorporated in the device of FIG. 14.

Referring to FIG. 17, water is introduced to the chamber through the inlet 276 and rotates. This rotating flow within the body acts as a hydrocyclone forming an outer and inner core. Any air that enters the system is forced to the center of the cyclone and may escape through the vent 275.

The rotating water flow discharges from the chamber 271 and expands to form a cone of water that is able to agitate and suspend any abrasive within the localized area of the cone. The reduced diameter portion at the lower end of the chamber aids flow distribution. The suspended abrasive is then drawn into the inner rotating core, by the reduced pressure, and is lifted to the top of chamber where it meets the outer rotating flow. The abrasive is accelerated in this flow and is drawn downwards as it rotates against the wall of the chamber. The pressure difference may be applied across the device between the bell mouth and the outlet 277, to aid the rotating particulate flow and increase abrasive discharge from the device. This pressure differential can be achieved by applying a suction to the outlet 277 or by employing a pressurized abrasive storage vessel within which the body is placed. In the latter case the outlet port 277 must be discharged to a lower pressure region external from the pressurized vessel.

Self-regulation is achieved because the amount of abrasive that can be fluidized and pumped at any time is dependent on the water supplied through inlet port 276 and the rotational velocity that this induces in the chamber. This effects the reduction in pressure within the inner core which draws the suspended particles into the chamber. This reduction in pressure is also influenced by the concentration of abrasive in the chamber and thus regulates the flow of further abrasive into the chamber. These factors are ultimately governed by the physical dimensions of the fluidizing device, and its geometry.

The storage vessel is designed so that the abrasive can flow freely towards the base of the vessel. The fluidising device is positioned near the base of the vessel as shown in FIG. 15. The particulate material is closely packed in a settled plug around the body 272 except in the region below it where the fluidization is taking place. Adequate clearance is given between the device and vessel to allow unhindered particulate flow around and into the device. The fluidizing effect of the emerging cone of water can be enhanced by situating the base of the device a short vertical distance above a flat plane. For this reason a vessel with conical sides for a main part, but a flat base over which the device is positioned would seem to be most advantageous.

Any of the fluidizing devices and non-return devices described above can be used in any of the mixing devices also described above.

We claim:

1. High pressure jetting apparatus comprising an abrasive cutting nozzle, a hopper for a supply of abrasive material, a container for forming a mixture of abrasive material and a carrier liquid at a point remote from the nozzle, a closable conduit for conducting said mixture at high pressure from the container to the nozzle to form a high velocity abrasive jet, means providing an endless circulating path through the container and the hopper when the closable conduit is closed for circulating carrier liquid between the container and the hopper to charge the container with abrasive material from the hopper and carrier liquid and thereby form said mixture, said means including an inlet conduit to the container, an outlet conduit from the container and means for selectively connecting and disconnecting the inlet and outlet conduits to and from the hopper, and means for supplying carrier liquid under pressure to the container through the outlet conduit to force said mixture from the container to the nozzle when the inlet and outlet conduits have been disconnected from the supply hopper and the closable conduit is open.

2. Apparatus as claimed in claim 1, comprising a filter in the outlet conduit, which filter becomes blocked when abrasive material in the container reaches the level of the filter to stop flow of slurry in the circulating path.

3. Apparatus as claimed in claim 1, comprising a bypass passage for carrier liquid to pass directly to the nozzle, bypassing the container.

4. Apparatus as claimed in claim 3, comprising a flow control device in said bypass passage.

5. Apparatus as claimed in claim 1, wherein said abrasive cutting nozzle utilizes only a single inlet thereto and the closeable conduit connects said single inlet to an outlet of the container.

6. An abrasive cutting apparatus comprising a hopper containing a mixture of liquid and abrasive material, an abrasive cutting nozzle located a substantial distance below the base of the hopper and utilizing only a single inlet thereto, and a conduit connecting an outlet near the base of the hopper to said inlet of the abrasive cutting nozzle for conducting liquid and abrasive material from the hopper to the nozzle, the liquid in the hopper and the conduit being pressurized solely by the effect of gravity on the liquid and said distance of the nozzle below the base of the hopper being such that the mixture of liquid and abrasive material is conducted to said nozzle at a high pressure generated solely by the weight of the mixture and sufficient for the nozzle to effect abrasive cutting.

7. Apparatus as claimed in claim 6, including at least one grit catch station means interposed along the length of said conduit for preventing abrasive material from sinking to the bottom of said conduit when flow of liquid and abrasive material to the abrasive cutting nozzle is stopped.

8. Apparatus comprising a container for a mixture of abrasive material and carrier liquid, an abrasive material supply hopper, first means for charging said container with said mixture of abrasive material and carrier liquid by circulating carrier liquid in an endless path running through said container and said abrasive material supply hopper such that the circulating carrier liquid transports abrasive material from said supply hopper to said container, and second means for discharging said mixture from said container by supplying carrier liquid under pressure to said container to force said mixture out of said container.

9. Apparatus as claimed in claim 8, wherein said first means includes an inlet conduit to said container, an outlet conduit from said container, and means for interconnecting said container and said supply hopper to effect the circulating of carrier liquid by way of said inlet conduit and said outlet conduit.

10. Apparatus as claimed in claim 9, wherein said second means includes means for connecting said outlet conduit to a source of carrier liquid under pressure to supply said carrier liquid under pressure to said container by way of said outlet conduit.

11. Apparatus as claimed in claim 9, wherein said inlet conduit and said outlet conduit are disposed near an upper end of said container and said container has a discharge conduit near a lower end thereof.

12. Apparatus as claimed in claim 11, wherein said discharge conduit includes an abrasive material trap.

13. Apparatus as claimed in claim 11, including filter means for blocking a carrier liquid flow from said container through said outlet conduit when the abrasive material in said container reaches a predetermined level.

14. Apparatus as claimed in claim 11, wherein said outlet conduit is disposed coaxially about said inlet conduit.

15. Apparatus as claimed in claim 14, including filter means disposed near an entrance of said outlet conduit for blocking carrier liquid flow from said container through said outlet conduit when the abrasive material in said container reaches a predetermined level.

16. Apparatus as claimed in claim 11, including an abrasive cutting nozzle utilizing only a single inlet thereto, and a conduit connecting said discharge conduit to said single inlet.

* * * * *